United States Patent [19]

Janzen et al.

[11] Patent Number: 4,920,578

[45] Date of Patent: May 1, 1990

[54] PATIENT'S GOWN

[76] Inventors: Bertha Janzen, Box 1503, Virden, Manitoba, Canada, R0M 2CO; Virginia Janzen, 14728 Deer Ridge Dr Se, Calgary, Alberta, Canada, T2J 6B5

[21] Appl. No.: 331,969

[22] Filed: Apr. 3, 1989

[51] Int. Cl.[5] ..... A41D 13/00

[52] U.S. Cl. ..... 2/114; 2/DIG. 7; 2/69

[58] Field of Search ..... 2/113, 114, DIG. 7, 2/105, 83, 106, 69, 69.5, 70, 71

[56] References Cited

U.S. PATENT DOCUMENTS*

| | | | |
|---|---|---|---|
| 818,351 | 4/1906 | Clark | 2/114 |
| 1,489,046 | 4/1924 | Thompson | 2/114 |
| 2,497,764 | 2/1950 | Doughty | 2/114 |
| 2,701,364 | 2/1955 | Palm | 2/114 |
| 2,768,383 | 10/1956 | De Witt | 2/114 |
| 2,807,022 | 9/1957 | Bonanni | 2/114 |
| 3,116,491 | 1/1964 | Previdi et al. | 2/114 |
| 3,276,036 | 10/1966 | Cater | 2/114 |
| 3,464,063 | 10/1969 | Hoegerman | 2/114 |
| 3,490,072 | 1/1970 | Keltner | 2/114 |
| 3,742,519 | 7/1973 | Wiley | 2/114 X |
| 3,824,625 | 7/1974 | Green | 2/114 |
| 3,911,499 | 10/1975 | Benevento et al. | 2/114 |
| 4,253,197 | 3/1981 | Posta | 2/69 |
| 4,422,186 | 12/1983 | Loney | 2/114 |
| 4,570,268 | 2/1986 | Freeman | 2/114 |
| 4,578,825 | 4/1986 | Vote | 2/DIG. 7 X |
| 4,622,699 | 11/1986 | Spriggs | 2/DIG. 7 X |
| 4,653,120 | 3/1987 | Leaf | 2/DIG. 7 X |
| 4,759,083 | 7/1988 | Belcher | 2/114 |
| 4,787,101 | 11/1988 | Feinberg | 2/105 |

*Primary Examiner*—Werner H. Schroeder
*Assistant Examiner*—Jeanette E. Chapman
*Attorney, Agent, or Firm*—Murray E. Thrift; Stanley G. Ade; Adrian D. Battison

[57] ABSTRACT

A patient gown has a body with two arm openings and a neck opening. A front panel or bodice extends downwardly from the neck opening with its side edges providing the front edge of the arm openings. Two bell sleeves extend outwardly over the arm openings and are secured to the body along the rear edges of the arm openings only. The front edges of the sleeves are releasably connected to the side edges of the bodice by releasable snaps so that the bodice can be dropped partially or fully on one or both sides. This provides partial or complete access to the patient chest area while maintaining as much body coverage as possible for the patient's dignity. The openings in the gown are coded to indicate which edges match in order to facilitate assembly of the gown. Color coding, matching geometric shapes and tactile codings are possible.

15 Claims, 6 Drawing Sheets

PATIENT'S GOWN

FIELD OF THE INVENTION

The present invention relates to patient's gowns and more particularly to gowns of the type intended for continuous use by hospital patients and the like.

BACKGROUND

The typical hospital gown now in use is a simple garment with a body and two sleeves. The body has an opening, usually worn at the back, that is closed with a tie at the neck and a second time midway down the back. While garments of this sort have certain economic advantages, they are not well suited for use during many medical procedures and they are not well adapted for use in the case of long term convalescence.

Alternative gowns have been proposed where the sleeves may be opened along a seam extending along the mid line of the sleeve. This does allow access to the upper chest area by exposing the arms, but it does not allow unrestricted access to the whole chest for auscultation of chest and heart sounds, the attachment of EKG electrodes or cardiac massage. This type of access usually requires bringing the gown up from the leg area. In addition, where limited access to the chest is required, as for example for a subclavian catheter or for breast feeding an infant, the sleeve must be undone and large portions of the patient's body exposed, which is not desirable from the point of view of patient dignity.

SUMMARY

The present invention is concerned with a gown that allows partial or complete exposure of a patient's chest while minimizing exposure of other parts of the patient's body. The gown is also intended to be handled readily by hospital personnel and patients themselves.

According to one aspect of the present invention there is provided a patient gown comprising:

a body with arm openings, a neck opening and a front panel with side edges that extend downwardly from the neck opening and define front edges of the arm openings;

sleeves extending outwardly over the arm openings and secured to the body along mating rear edges of the arm openings and the sleeves; and releasable front panel fastener means for releasably connecting the side edges of the front panel to front edges of respective ones of the sleeves.

When worn, the front panel or bodice is attached to each sleeve along a line from the neck clavicle area to the anterior axillary line. This allows the partial opening of one side of the gown for access to the clavicle area, the full opening of one side of the bodice for breast feeding or examination purposes, or full opening of the front of the gown for access to the whole chest. At the same time, the sleeves may remain in place, so that the shoulders and upper arms remain covered.

It is preferred that the front and rear edges of the sleeves are shorter than the arm openings and that the sleeves themselves are unconnected at the bottom edges. This yields a "bell" sleeve that provides ample coverage without closing in the axilla area, thus allowing considerable freedom of movement. This sleeve can easily accommodate a large arm and avoids chafing of the under arm areas. The sleeve can be lifted up onto the shoulder to expose the upper arm for intravenous lines that have to be placed high in the arm. It allows for blood pressure cuffs and accommodates arm casts that would otherwise not fit through a regular sleeve. Because the sleeve detaches from the bodice of the gown, tubing of any type can pass through the sleeve without the need to disconnect the tubing. This is of particular importance as every disconnection of the tubing pieces the patient at some risk as it increases the chance of infection and also increases the potential of air entering the tubing.

The body of the gown preferably has a back opening extending the full length of the gown and overlapping a sufficient amount to prevent back opening. This resistance to back opening may be enhanced by using a pair of laterally spaced snaps at the top of the back opening.

In hospital gowns with multiple openings, it is often a time consuming process for both hospital personnel and patients to sort out the matching sides of the openings. This problem is compounded for patients who are not familiar with the gown arrangement.

Thus, according to another aspect of the present invention there is provided, in a patient gown comprising a plurality of panels of fabric with pairs of mating panel edges, and releasable fastening means for releasably fastening the mating edges together, the improvement comprising:

matching coding means located on the panel edges of at least two pairs of mating panel edges, the coding means of each pair of matong panel edges being distinct from the other.

With the coding, matching of the mating edges is readily accomplished.

The coding may be a colour coding using differently coloured edge bindings on the opposite sides of the bodice and matching colours on at least the front edges of the sleeves. Alternatively, different geometric shapes may be marked on the edges, preferably where the fasteners are located. Tactile codings may also be used.

BRIEF DESCRIPTION OF THE DRAWINGS

In the accompanying drawings, which illustrate exemplary embodiments of the present invention.

DETAILED DESCRIPTION

Figure 1:
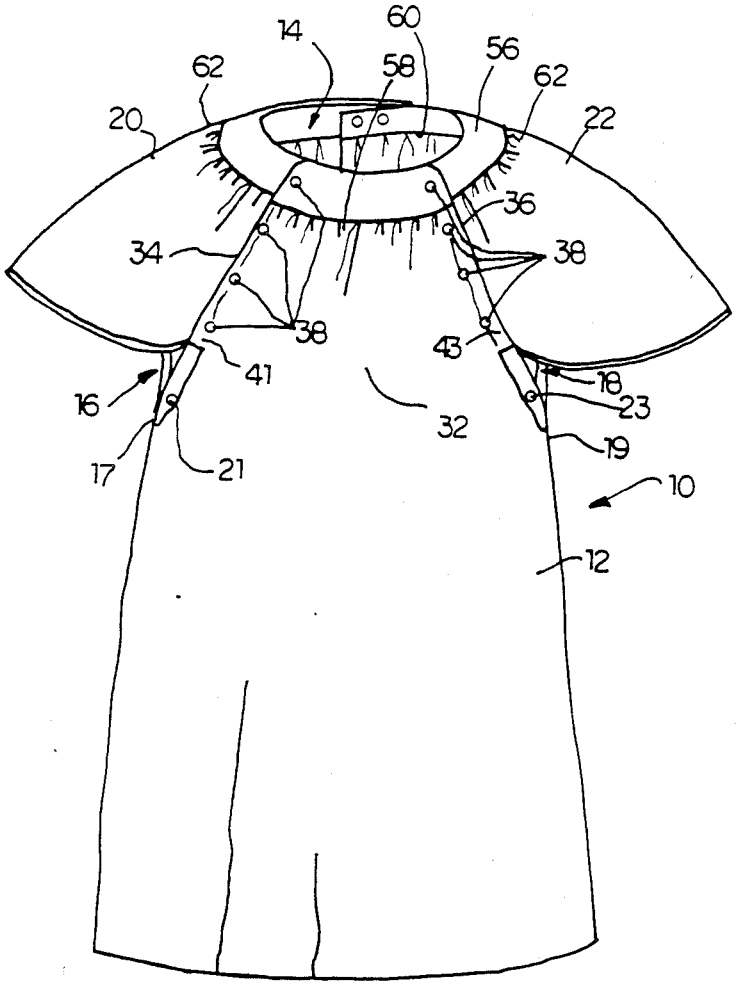
FIG. 1 is a front view of a gown according to the present invention.

Referring to the accompanying drawings, and especially FIGS. 1–5, there is illustrated a patient's gown 10 with a body 12 having a neck opening 14 and two arm openings 16 and 18. The arm openings 16 and 18 are quite deep and extend down to the points 17 and 19 respectively. Lower portions of these openings are closed when desired by snap fasteners 21 and 23.

Sleeves 20 and 22 extend outwardly over the arm openings 16 and 18 respectively. They are secured to the body along seams 24 and 26 joining the rear edges of the arm openings and the rear edges of the sleeves.

The front edges 28 and 30 of the sleeves 20 and 22 respectively are joined to a front panel or bodice 32 of the gown along its respective side edges 34 and 36 by snap fasteners 38. The edges 34 and 36 define the front edges of the respective arm holes 16 and 18.

A coloured edge binding 40 extends along the side edge 34 of the bodice 32 and along the back of the arm opening 16 from the sleeve to point 17. Binding 40 is complemented by a coloured binding 41 of the same colour along the edge of the sleeve 20. Similarly, a coloured binding 42 of a colour that contrasts with the colour of bindings 40 and 41 extends along the side edge 36 of the bodice 32, and the back edge of the arm opening 18. The edge 30 of sleeve 22 carries a coloured binding 43 of the same colour as binding 42. The edges are therefore colour coded to their mates so that when the gown is retrieved from a loose pile of laundry, it may readily be assembled.

Figure 5:
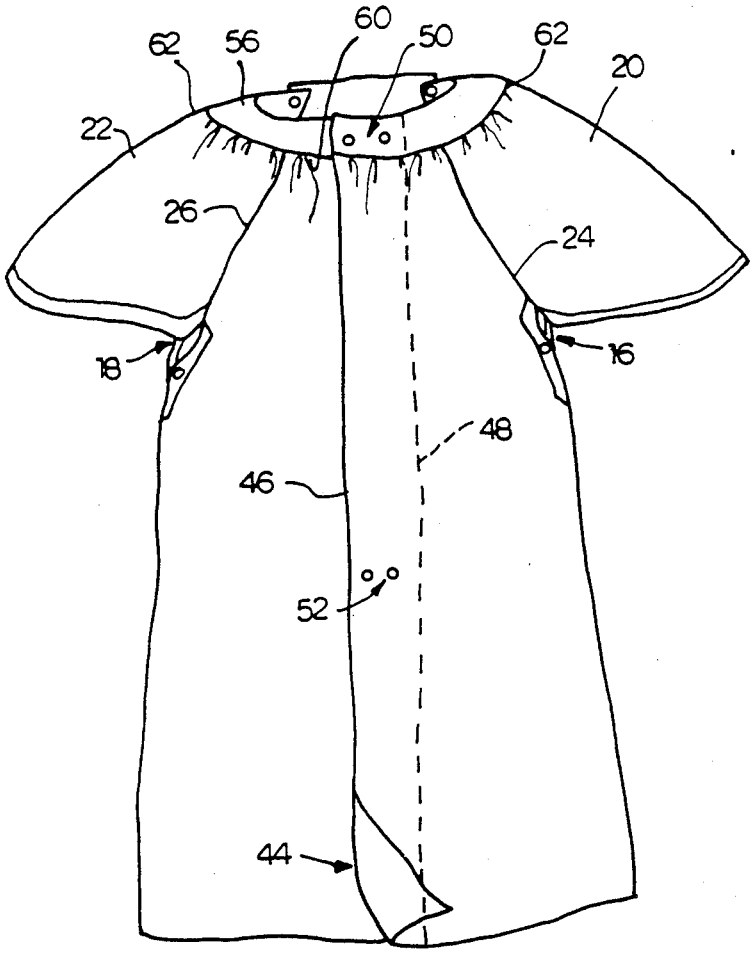
FIG. 5 is a back view of the gown.

As illustrated most particularly in FIG. 5, the gown has a back opening 44 defined by two back edges 46 and 48. The edges are overlapped by about 4" and releasably fastened to one another by a pair of snap fasteners 50 at the top and by ties 52 part way down. The snap fasteners are laterally spaced and the ties so positioned that the overlap is maintained and gapping of the gown back is minimized.

The gown has a yoke 56 around the neck opening 14. The yoke separates between the sleeves and the front panel 32 and at the back opening 44. The front panel 32 is gathered at 58 where it joins the yoke. The back panel is likewise gathered at 60 where it is connected to the yoke. This allows the body of the gown, and especially the bodice, to be full and comfortable to wear. The sleeves are likewise gathered at 62 where they join the yoke so that they are not tight and constricting on a wearer.

Figure 6:
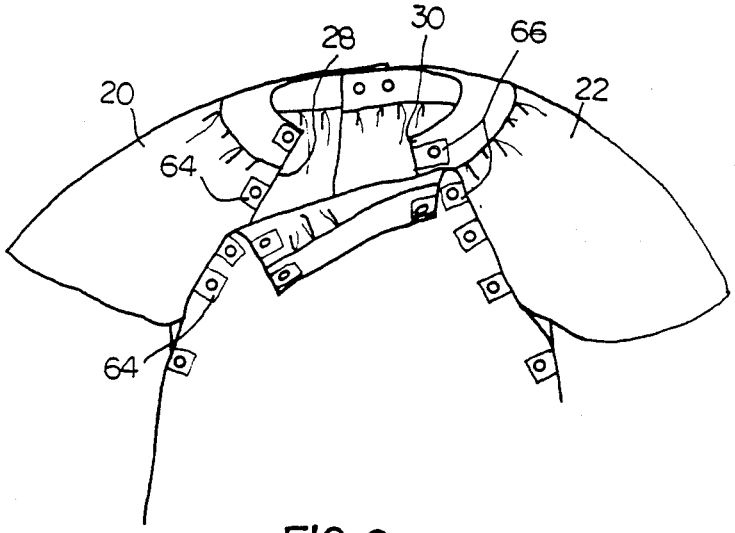
FIG. 6 is a view like FIG. 2 of an alternative embodiment of gown.

FIG. 6 illustrates an alternative embodiment of the gown where the visual coding along the edges of the front panel and the sleeves whether they join is provided by squares marked on the fabric of the gown along the sleeve edge 20 and the mating front panel edge 32 and semi-circles 66 marked along the sleeve edge 30 and the front panel edge 36. The squares and semi-circles may be colour coded as well. They are, as illustrated, spaced along the edges and associated with respective ones of the snap fasteners so that the snap fastener locations are readily determined.

In alternative embodiments, the coding may be other than visual. For example, a tactile coding with a shape or surface texture that can be distinguished by feel may be used.

Figure 2:
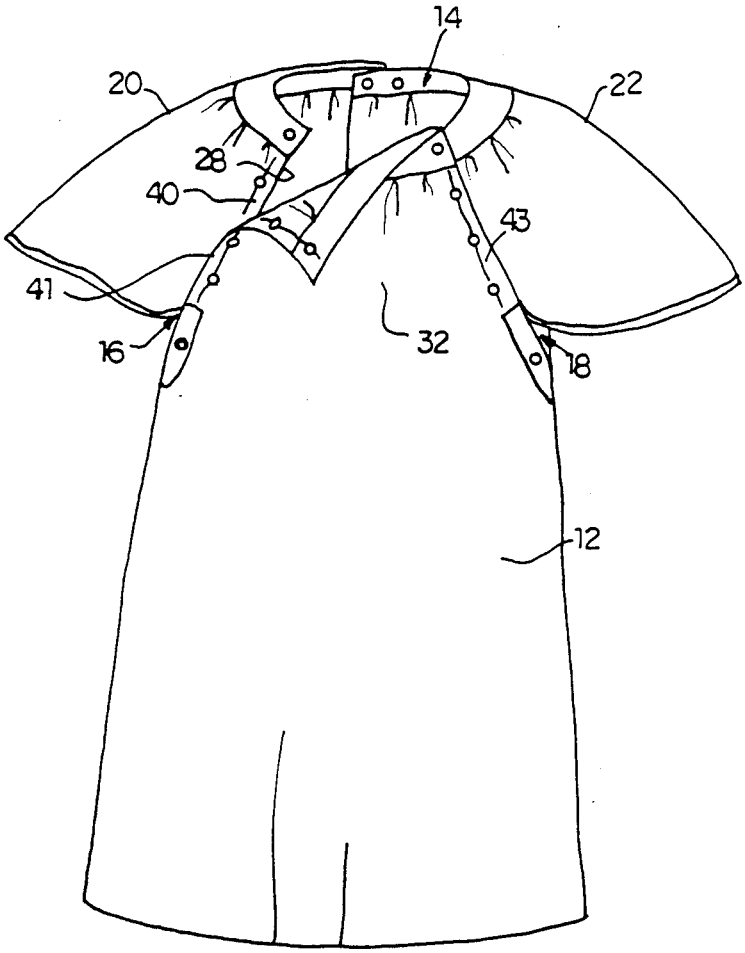
FIG. 2 is a view like FIG. 1 showing the gown partially opened on one side.

The gown as worn has the appearance illustrated in FIGS. 1 and 5. To provide access to the clavicle area of a wearer, it is only necessary to partially open one side of the front panel as illustrated in FIG. 2. The exposure of the patient is minimal while providing acess for subclavian subclavical catheters. In other gowns, the gown must be completely removed from the arm and shoulder to provide this access.

Figure 3:
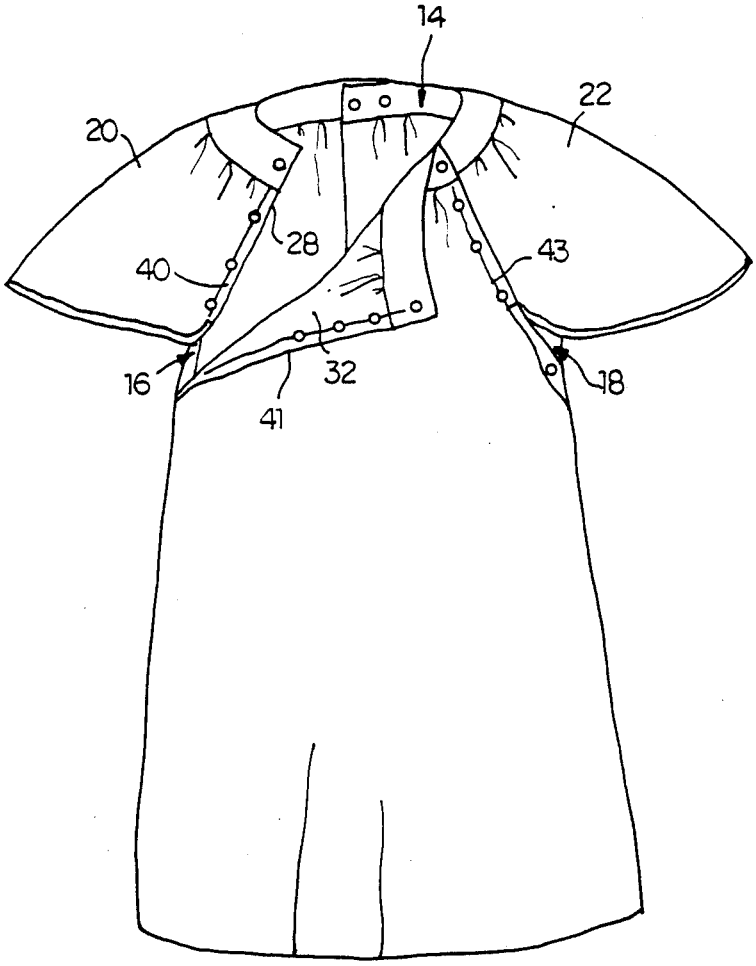
FIG. 3 is a view like FIG. 1 showing the gown fully opened on one side.

FIG. 3 illustrates the full opening of one side of the gown which exposes one side of the chest, such as for infant nursing or other cases where such limited exposure is necessary. At the same time, the sleeve 20 remains fully in place limiting the exposure of the patient's body so that dignity is maintained.

Figure 4:
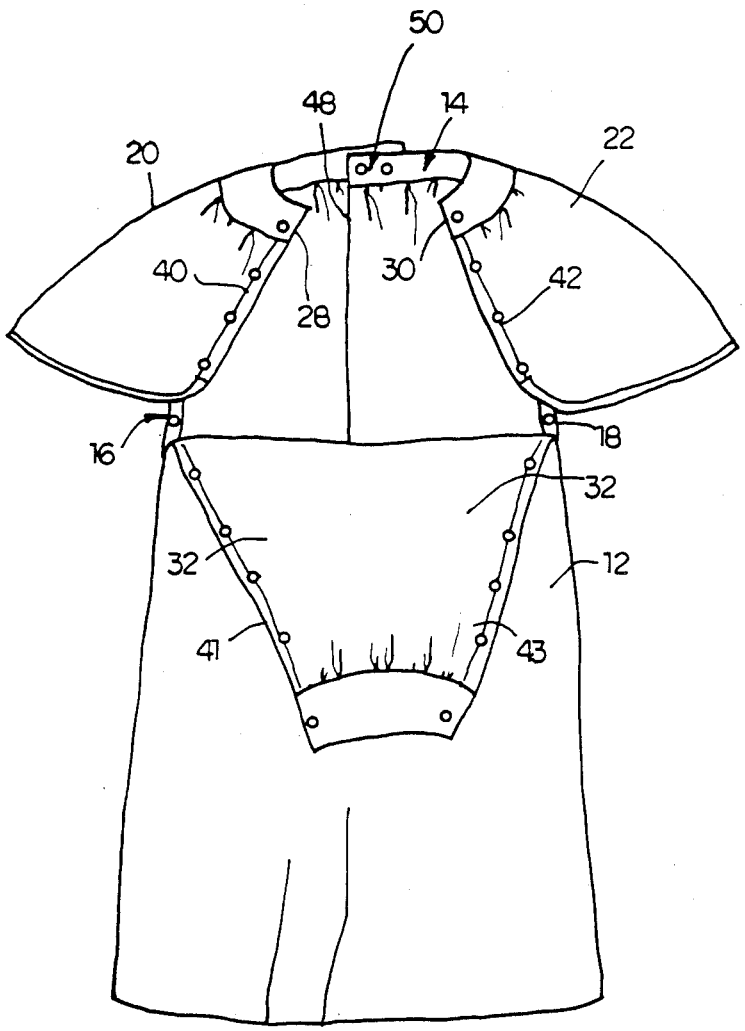
FIG. 4 is a view like FIG. 1 showing the gown with the front fully opened.

FIG. 4 illustrates the manner in which the full front of the gown can be opened for examination or treatment purposes while leaving the gown in place from the waist down and leaving the sleeves draped over the patient's shoulders. It will be observed that the relatively large arm openings and the bell type sleeves permit the gown to be opened fully to the waist of a wearer rather than simply to the bottom of the sleeves.

Where necessary, the upper arm is readily accessed, even with the gown fully fastened as illustrated in FIG. 1, simply by raising the sleeve and folding it back under the shoulder. The gown thus provides excellent access to various parts of a patient's body for medical treatment or other reasons.

While particular embodiments of the present invention have been described in the foregoing, it is to be understood that other embodiments are possible within the scope of the present invention. Thus, for example, it is possible to use the coding system for identifying mating panel edges in other types of gowns with plural openings. It is therefore to be understood that the scope of the invention is to be ascertained solely by reference to the accompanying claims.

We claim:

1. A patient gown comprising:

a body with two arm openings each with a front edge and a back edge, a neck opening, a front panel with side edges that extend downwardly from the neck opening adjacent heads of the respective clavicles of a wearer, over the wearer's respective subclavian areas to at least the mid axillary line, the front panel side edges defining the front edges of the arm openings, and back panel means extending from the front panel for closing the back of the gown and having side edges defining the back edges of the respective arm openings;

sleeve panels extending outwardly over the arm openings the sleeve panels having front edges shorter than the front edges of the arm openings and back edges shorter than the back edges of the arm openings, the back edges of the sleeve panels being secured to the back panel means along upper parts of the respective back edges of the arm openings; and releasable front panel fastener means for releasably connecting the front edges of the sleeve panels to the side edges of the front panel.

2. A gown according to claim 1 wherein the body includes a yoke extending around the neck opening, the body and sleeves being secured to and extending from the yoke.

3. A gown according to claim 2 wherein the body and sleeves are gathered where they are secured to the yoke.

4. A gown according to claim 1 wherein the back panel means comprise a back opening extending the full length of the gown from the neck opening to a bottom edge, and including releasable back fastener means for releasably closing the back opening.

5. A gown according to claim 4 wherein the releasable back fastener means comprise means for fastening together portions of the gown along opposite sides of the back opening in an overlapping relation.

6. A gown according to claim 5 wherein the releasable back fastener means comprise a pair of laterally spaced snap fasteners at the top of the back opening.

7. A gown according to claim 1 including coding means on each side edge of the front panel and matching coding means on the front edge of the associated sleeve, the coding means for the two side edges of the front panel being readily distinguishable one from the other.

8. A gown according to claim 1 wherein the boding means comprises different colours marked on the two side edges of the front panel and matching colours on the mating front edges of the respective sleeves.

9. A gown according to claim 7 wherein the coding means comprises different geometric shapes marked on the two side edges of the front panel and matching geometric shapes on the mating front edges of the respective sleeves.

10. A gown according to claim 5 including:

matching coding means located on the panel edges of at least two pairs of mating panel edges, the coding means of each pair of mating panel edges being distinguishable from the other.

11. A gown according to claim 10 wherein the coding means comprise matching colours on the mating panel edges.

12. A gown according to claim 10 wherein the coding means comprise matching geometric shapes marked on the mating panel edges.

13. A gown according to claim 12 wherein the geometric shapes are spaced along the edges.

14. A gown according to claim 13 wherein the releasable fastening means comprise means spaced along the matching panel edges and associated with respective ones of the geometric shapes.

15. A gown according to claim 10 wherein the releasable fastening means comprise snap fasteners spaced along the matching panel edges and associated with respective markings of the coding means.

* * * * *